United States Patent [19]

Lehtinen

[11] 4,421,064

[45] Dec. 20, 1983

[54] HEATING BOILER

[76] Inventor: Alpo S. Lehtinen, Tanokas, 32610 Vampula, Finland

[21] Appl. No.: 314,739

[22] Filed: Oct. 23, 1981

[30] Foreign Application Priority Data

Oct. 27, 1980 [FI] Finland ..... 803363

[51] Int. Cl.[3] ..... F22B 31/04

[52] U.S. Cl. ..... 122/15; 122/22; 110/260; 110/261; 110/347

[58] Field of Search ..... 110/263, 260, 265, 261; 122/2, 22, 15

[56] References Cited

U.S. PATENT DOCUMENTS

| | | | |
|---|---|---|---|
| 3,865,084 | 2/1975 | DePoister | 110/261 |
| 3,877,440 | 4/1975 | Winkin | 110/260 |
| 4,150,631 | 4/1979 | Frey et al. | 110/265 |
| 4,173,189 | 11/1979 | Cooper | 110/106 |
| 4,206,723 | 6/1980 | Kunkel | 122/2 |
| 4,246,853 | 1/1981 | Mehta | 110/261 |
| 4,296,711 | 10/1981 | Bilberg | 122/22 |
| 4,316,420 | 2/1982 | Kochey | 110/347 |

*Primary Examiner*—Henry C. Yuen

*Attorney, Agent, or Firm*—Eugene E. Geoffrey, Jr.

[57] ABSTRACT

The invention reads on a heating boiler for solid fuel, comprising a combustion volume with fuel feeding aperture, air entry apertures and chimney flue, and a water volume, the latter bordering on said combustion volume by mediation of convection plates. As taught by the invention, the boiler comprises air guiding elements for guiding the combustion air substantially across the combustion volume so that the point of air entry moves with time from one point in the combustion volume across the combustion volume for burning the fuel in the combustion volume zonally. The air guiding elements may consist of air entry apertures provided in the wall, disposed in a row across the combustion volume, and they may incorporate closing members for consecutively opening and closing the apertures e.g. with the aid of a governing apparatus from one margin to the opposite margin of the combustion volume. The air guiding elements may comprise an air inlet tube disposed to swivel or alternatively move in translation over the combustion volume.

3 Claims, 3 Drawing Figures

HEATING BOILER

The present invention concerns a heating boiler for solid fuel, comprising a combustion volume with fuel feed aperture, air inlet aperture and chimney flue, and a water volume, said water volume bordering against the combustion volume by mediation of convection plates.

In boilers using solid fuel, such as bundled small wood, straw bales, peat, etc., problems are incurred in controlling the combustion process. The supplying of solid fuel into the boiler is effected by separate single fillings, that is by batches. Control of the combustion process is only feasible by throttling the flue gases and the draft, that is by controlling the flow rate of the combustion air. However, control of flue gases and combustion air gives rise to incomplete combustion, thus lowering the efficiency. Furthermore, particularly when straw and peat are being burned, arch-building tends to occur in the combustion volume, and this impedes the combustion.

The object of the present invention is to provide a boiler which eliminates the drawbacks mentioned. It is a particular object of the invention, to provide a boiler which can be fired with straw, bundled small wood, peat, and equivalent solid fuel in such manner that the combustion process is completely controlled and to the combustion can be conducted the optimum air flow at all and any stages of the combustion. A further object of the invention is: to provide a boiler using the solid fuels mentioned and which has an efficiency substantially superior to boilers of prior art using solid fuel. It is a particular object of the invention: to provide a boiler meeting the requirements stated above, with excellent efficiency, and which is appropriate to be used in heating small houses.

The invention is characterized by that which has been stated in the characteristic features part of the main claim.

Figure 1:
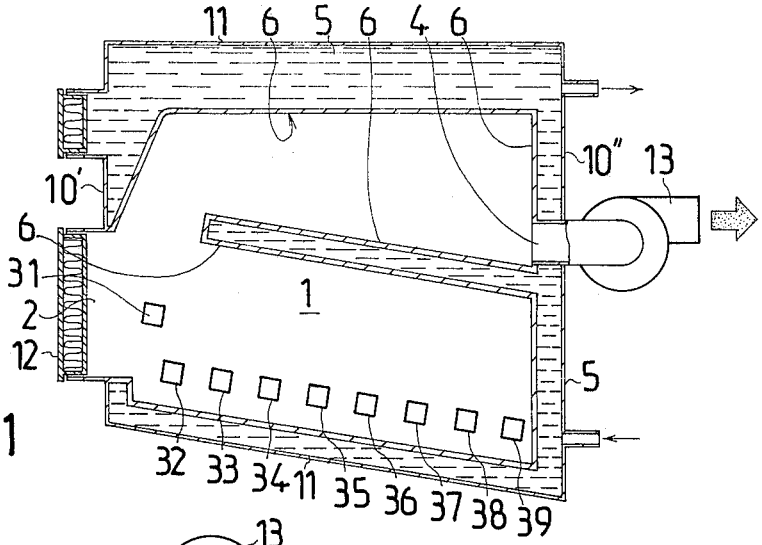
Figure 2:
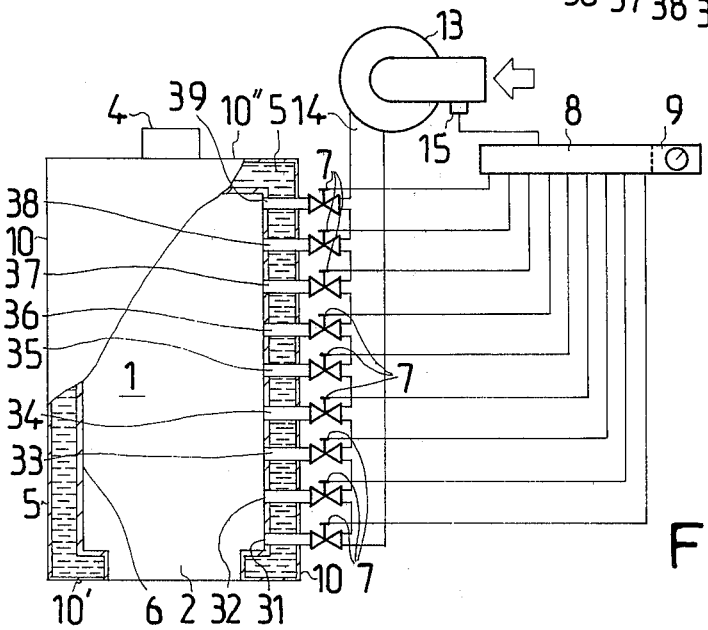
Figure 3:
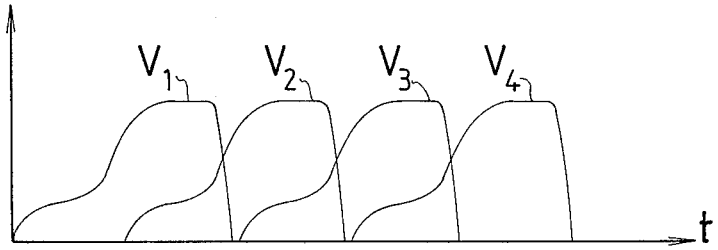

The invention is described in the following in detail with the aid of embodiment examples, with reference being made to the attached drawing, wherein:

FIG. 1 presents in elevational view, and in section, a boiler according to the invention;

FIG. 2 presents in top view, and partly sectioned, another boiler according to the invention; and FIG. 3 displays the air supply flow rates plotted over time, to the boiler of FIG. 1.

The boilers depicted in FIGS. 1 and 2, using solid fuel such as bundled small wood and straw bales, comprise a combustion volume confined by side walls and top and bottom 10,11, a fuel introduction aperture 2 (in FIG. 1 with door 12), and with chimney flue 4. Moreover, the boilers of FIG. 1 and 2 comprise a water volume 5, bordering on the combustion volume 1 by the convection plates 6.

In addition, the boilers of FIGS. 1 and 2 comprise, as taught by the invention, air guiding elements 7,8,31–30 for directing the combustion air, in the course of time, point by point across the combustion volume 1 so that the point of air entry is displaced, as time progresses, from at least one point in the combustion volume to the outside margin of the combustion volume, with a view to burning the solid fuel in said combustion volume by consecutive zones, with the combustion zone progressing across the fuel bed, with the point of air entry and with time. The air entry into the boilers is substantially shut off in other parts, the air guiding elements excluded.

In the embodiment shown in FIG. 1, the combustion volume of the boiler has elongated shape and it is comparatively narrow, its length for instance more than twice the breadth of the combustion volume. In the side wall of the combustion volume (in the figure, the rearmost wall parallelling the plane of the drawing) have been provided air entry apertures 31–39, which have been arranged substantially in a row from the front wall 10' to the rear wall 10'' of the combustion volume. The air entry apertures 31–39 have been fitted with a closing member 7 (not visible in the figure) arranged to consecutively open and close the apertures in the course of time. Thus, in the embodiment of FIG. 1 the air entry aperture 31 closest to the fire door 12 is open as the fuel is ignited. The fuel will then only burn in the vicinity of said air entry aperture 31. In the course of time, e.g. within 1 to 60 minutes, the aperture 32 starts to open, whereby the solid close to this aperture also receives combustion air in sufficient quantity and begins to burn. Next, again within 1 to 60 minutes, the air entry aperture 33 begins to open, thus causing the fuel in the vicinity of this aperture to start to burn as well. The combustion process thus proceeds zonally through the entire boiler, with the air entry apertures that open up. Combustion takes place concentratedly on a small area, whereby at any one time only part of the fuel is on fire. Hereby is achieved a high temperature in the combustion zone, and complete combustion as a result hereof. The combustion is completely controlled and it is possible to conduct to the fuel the optimum air quantity. The fuel need not move; arching detriments are avoided in addition. It is possible to use in the boiler, long, thick and otherwise difficult-to-burn solid fuel, such as bundled small wood, straw bales, peat, etc.

Control of the combustion phenomenon is rendered easier if the air entry apertures 31–39 close accordingly as the fuel adjacent to them has been burnt up. Thus, for instance (FIGS. 1 and 2) when the aperture 34 has opened fully and the combustion process slowly ceases opposite this aperture, as the fuel is burned up, the aperture 34 begins to open, whereupon through the aperture 34 air is further conducted into the boiler to serve as secondary air. When the aperture 35 delivers full air flow, the aperture 34 will close in order to eliminate excessive furnace draft.

The apparatus schematically depicted in FIG. 2 comprises a special governing unit 8 with clock means 9, these two in cooperation governing the opening and closing of the air apertures 31–39, as has been presented above in connection with the boiler of FIG. 1. The boiler of FIG. 2 comprises a blower 13, arranged to blow combustion air into the main air duct 14 and further through valves 7 governed by the governing apparatus 8,9 to the air entry apertures 31–39 and into the combustion volume 1 of the boiler. In FIG. 1, the air circulation in the boiler is achieved with the aid of the flue gas exhauster 13 connected to the flue passage 4; in the embodiment of FIG. 1, combustion takes place at a subatmospheric pressure and in that of FIG. 2, at an over-pressure.

In FIG. 3 are shown the flow rates passed through the air entry apertures 31–34, of the boilers of FIGS. 1 and 2, plotted over time. The flow $V_1$ passed through aperture 31 into the boiler increases with time, comparatively slowly at first as the aperture opens. When the aperture has opened fully and the air flow has reached its maximum, the next aperture 32 begins to open and the flow rate $V_2$ conducted through the latter aperture begins to increase. On ceasing of combustion opposite aperture 31, this will close, and aperture 32 opens fully, the respective air flow $V_2$ attaining its maximum. The same is repeated throughout the boiler at the apertures 31–39, one after the other. Air is mainly only introduced at a given point at any time, i.e., in the combustion zone, the air entry to all other parts of the boiler being shut off. The total air flow is fairly constant and it depends mainly on the power of the blowers, blower 13 in FIG. 2 and blower 13 in FIG. 1, and on the throttling of flue gases, if any.

The combustion process can be controlled in the boiler of the invention on the basis of timing the opening and closing of the air entry apertures 31–39 in addition to the conventional modes of control, e.g. flue gas throttling, blower power (effected in FIG. 2 with the aid of the control means 15 of the blower 13, governed by the governing apparatus 8,9).

The members 7 for closing the air entry apertures employed in the boiler of the invention may consist e.g. of standard motor-actuated, pneumatically controlled, magnetic valve-controlled or damper-controlled valves or shut-off means known in the art of gas manipulation. Furthermore, the closing members may comprise two tubes one inside the other and which are rotatable with reference to each other, the shell surface of one of them being provided with passages constituting the air entry apertures and in the other has been formed an aperture or a slot, which as the tubes are rotated opens the said air entry apertures each in its turn.

The air entry passages, indicated in the figures by the reference numerals 31–39, may if desired be placed for instance on one side of the combustion chamber, on both sides, on top, or below. The air guiding members may consist, instead of separate air entry apertures, also e.g. of a throughflow member which swivels or moves in translation with a view to guiding the combustion air across the combustion volume starting at a given point thereof.

The embodiment examples are intended for illustration of the invention, without in any way confining it.

I claim:

1. A heating boiler comprising top, bottom, front, rear and side walls, at least certain of said walls being formed to retain water to be heated, said walls defining a combustion chamber for receiving fuel to be burned therein and said front wall having an aperture and cooperating door for introducing said fuel into said chamber, a flue communicating with said combustion chamber, air guiding means for introducing air into said chamber for burning of said fuel, and means for operating said air guiding means for displacing the point of air entry into said combustion chamber to effect burning of said fuel in successive zones at predetermined time intervals, said air guiding means comprising a plurality of apertures in at least one wall of said boiler spaced throughout the length of the fuel combustion zone of said chamber and the last said means including valves coupled with each of said apertures and means for successively opening and closing each of said apertures in succession to effect burning of said fuel in successive zones throughout the length of the combustion zone, the last said means being operable to first deliver air to the first of said apertures at one edge of the combustion zone, then after the fuel adjoining said first aperture is burned the last said means opens the valve controlling the air to the second aperture and when maximum air flow through the second aperture is achieved the last said means closes the first aperture and the operation of the last said means continues in like manner until burning has been proceeded throughout the combustion zone.

2. A heating boiler according to claim 1 wherein said flue is provided with an exhaust fan to draw air through each aperture as the associated valve is opened.

3. A heating boiler according to claim 1 including at least one compressed air supply communicating with said apertures whereby said air is delivered to each aperture in succession.

* * * * *